US007763129B2

(12) United States Patent
Mourer et al.

(10) Patent No.: US 7,763,129 B2
(45) Date of Patent: Jul. 27, 2010

(54) METHOD OF CONTROLLING FINAL GRAIN SIZE IN SUPERSOLVUS HEAT TREATED NICKEL-BASE SUPERALLOYS AND ARTICLES FORMED THEREBY

(75) Inventors: David Paul Mourer, Beverly, MA (US); Brian Francis Mickle, West Chester, OH (US); Shesh Krishna Srivatsa, Cincinnati, OH (US); Eric Scott Huron, West Chester, OH (US); Jon Raymond Groh, Loveland, OH (US); Kenneth Rees Bain, Loveland, OH (US)

(73) Assignee: General Electric Company, Schenectady, NY (US)

( * ) Notice: Subject to any disclaimer, the term of this patent is extended or adjusted under 35 U.S.C. 154(b) by 292 days.

(21) Appl. No.: 11/379,203

(22) Filed: Apr. 18, 2006

(65) Prior Publication Data

US 2007/0240793 A1 Oct. 18, 2007

(51) Int. Cl.
*C22F 1/10* (2006.01)

(52) U.S. Cl. ..... 148/564

(58) Field of Classification Search ..... 148/564
See application file for complete search history.

(56) References Cited

U.S. PATENT DOCUMENTS 4,957,567 A 9/1990 Krueger et al.
5,061,324 A 10/1991 Chang
5,360,496 A 11/1994 Kuhlman et al.
5,374,323 A 12/1994 Kuhlman et al.
5,413,752 A 5/1995 Kissinger et al.
5,529,643 A 6/1996 Yoon et al.
5,571,345 A 11/1996 Ganesh et al.
5,584,947 A 12/1996 Raymond et al.
5,584,948 A 12/1996 Huron
5,649,280 A 7/1997 Blankenship et al.
5,662,749 A 9/1997 Chang
5,693,159 A 12/1997 Athey et al.
5,725,692 A 3/1998 DeLuca et al.
5,759,305 A 6/1998 Benz et al.
5,788,785 A 8/1998 DeLuca et al.
5,820,700 A 10/1998 DeLuca et al.
5,891,272 A 4/1999 Raymond et al.

(Continued)

*Primary Examiner*—Roy King
*Assistant Examiner*—Jie Yang
(74) *Attorney, Agent, or Firm*—William Scott Andes; Gary M. Hartman; Domenica N. S. Hartman

(57) ABSTRACT

A method of forming a component from a gamma-prime precipitation-strengthened nickel-base superalloy so that, following a supersolvus heat treatment the component characterized by a uniformly-sized grain microstructure. The method includes forming a billet having a sufficiently fine grain size to achieve superplasticity of the superalloy during a subsequent working step. The billet is then worked at a temperature below the gamma-prime solvus temperature of the superalloy so as to form a worked article, wherein the billet is worked so as to maintain strain rates above a lower strain rate limit to control average grain size and below an upper strain rate limit to avoid critical grain growth. Thereafter, the worked article is heat treated at a temperature above the gamma-prime solvus temperature of the superalloy for a duration sufficient to uniformly coarsen the grains of the worked article, after which the worked article is cooled at a rate sufficient to reprecipitate gamma-prime within the worked article.

37 Claims, 6 Drawing Sheets

U.S. PATENT DOCUMENTS

| | | | |
|---|---|---|---|
| 5,938,863 | A | 8/1999 | Malley |
| 5,976,280 | A | 11/1999 | DeLuca et al. |
| 6,059,904 | A | 5/2000 | Benz et al. |
| 6,096,141 | A | 8/2000 | King et al. |
| 6,405,601 | B1 | 6/2002 | Yang |
| 6,409,853 | B1 | 6/2002 | Thamboo et al. |
| 6,521,175 | B1 | 2/2003 | Mourer et al. |
| 6,866,769 | B2 | 3/2005 | Anderson et al. |

METHOD OF CONTROLLING FINAL GRAIN SIZE IN SUPERSOLVUS HEAT TREATED NICKEL-BASE SUPERALLOYS AND ARTICLES FORMED THEREBY

BACKGROUND OF THE INVENTION

The present invention generally relates to methods for processing nickel-base superalloys. More particularly, this invention relates to a method for producing an article from a nickel-base superalloy, in which nonuniform nucleation tendencies are minimized and grain growth is controlled in the alloy during supersolvus heat treatment, so as to yield an article characterized by a microstructure with a desirable, substantially uniform grain size distribution.

Powder metal gamma prime (γ') precipitation-strengthened nickel-base superalloys are capable of providing a good balance of creep, tensile, and fatigue crack growth properties to meet the performance requirements of certain gas turbine engine components, such as turbine disks. Typically, components produced from powder metal gamma-prime precipitation-strengthened nickel-base superalloys are consolidated, such as by hot isostatic pressing (HIP) and/or extrusion consolidation. The resulting billet is then isothermally forged at temperatures slightly below the gamma-prime solvus temperature of the alloy to approach superplastic forming conditions, which allows the filling of the die cavity through the accumulation of high geometric strains without the accumulation of significant metallurgical strains. These processing steps are designed to retain a fine grain size within the material (for example, ASTM 10 to 13 or finer), achieve high plasticity to fill near net shape forging dies, avoid fracture during forging, and maintain relatively low forging and die stresses. (Reference throughout to ASTM grain sizes is in accordance with the scale established in ASTM Standard E 112.) In order to improve fatigue crack growth resistance and mechanical properties at elevated temperatures, these alloys are then heat treated above their gamma-prime solvus temperature (generally referred to as supersolvus heat treatment), to cause significant, uniform coarsening of the grains.

During conventional manufacturing procedures involving hot forging operations, a wide range of local strains and strain rates may be introduced into the material that can cause non-uniform critical grain growth during post forging supersolvus heat treatment. Critical grain growth (CGG) as used herein refers to random localized excessive grain growth in an alloy that results in the formation of grains whose diameters exceed a desired grain size range for an article formed from the alloy. Critical grain growth may be manifested as individual grains that exceed the desired grain size range, multiple individual grains that exceed the desired grain size range in a small region of the article, or large areas of adjacent grains that exceed the desired grain size range. Because critical grain growth is believed to be driven by excessive stored energy within the worked article, the grain diameters of these grains are often substantially larger than the desired grain size. In view of the above, the term "uniform" will be used in reference to grain size and growth characterized by the substantial absence of critical grain growth. Desired ranges for forged gas turbine engine components often entail grain sizes of about ASTM 9 and coarser, such as ASTM 3 to 9, but are generally limited to a range of several ASTM units in order to be considered uniform, such as ASTM 6 to 8.

The presence of grains within a component that significantly exceed the desired grain size range are highly undesirable, in that the presence of such grains can significantly reduce the low cycle fatigue resistance of the article and can have a negative impact on other mechanical properties of the article, such as tensile and fatigue strength. In addition to the case of critical grain growth described above, where the regions of critical grain growth can exhibit grain sizes substantially larger than the desired grain size range and a grain distribution that is therefore not uniform, components can also be produced with structures that are more uniform but still undesirable if the average grain size is slightly coarser than the desired grain size. As an example, if the desired grain size range for a nickel-base superalloy article is ASTM 6 to ASTM 8, random grain growth that produces individual or small regions of grains coarser than about ASTM 3, or large regions of the forging that are uniform in grain size but with a grain size coarser than the ASTM 6-8 range, will often be undesirable. Disks and other critical gas turbine engine components forged from billets produced by powder metallurgy (P/M) and extrusion consolidation generally exhibit a lesser propensity for critical grain growth than if forged from billets produced by conventional cast and wrought processing or spraycast forming techniques. However, such components are still susceptible to critical grain growth during supersolvus heat treatment.

Commonly-assigned U.S. Pat. No. 4,957,567 to Krueger et al. teaches a process for eliminating critical grain growth in fine grain nickel-base superalloy components by controlling the localized strain rates experienced during the hot forging operations. Krueger et al. teach that local strain rates must generally remain below a critical value, $\dot{\epsilon}_c$, in order to avoid detrimental critical grain growth during subsequent supersolvus heat treatment. Strain rate is defined as the instantaneous rate of change of geometric strain with time. Further improvements in the control of final grain size have been achieved with the teachings of commonly-assigned U.S. Pat. No. 5,529,643 to Yoon et al., which places an upper limit on the maximum strain rate gradient during forging, and U.S. Pat. No. 5,584,947 to Raymond et al., which teaches the importance of a maximum strain rate and chemistry control. Implementation of the teachings of Krueger et al., Yoon et al., and Raymond et al. has generally required the use of very slow ram speed control of the forging press head (generally with a simple linear decay vs. stroke control scheme), coupled by simulative modeling to translate the press head deformation rate into actual metal strain rate as a function of temperature, constitutive property data for the forging stock, die shape, and die or mult lubrication. While the teachings of Krueger et al., Yoon et al., and Raymond et al. have been largely effective in controlling critical grain growth, mechanical properties would further benefit from improved control of the grain size distribution in components forged from fine grain nickel-base superalloys, including a grain size distribution that is without critical grain growth and with the average grain size as fine as possible and as narrow as possible. Such a capability would be particularly beneficial for higher temperature, higher gamma-prime content (e.g., about 50 volume percent and above) superalloys that have been developed, such as René104 (R104) disclosed in commonly-assigned U.S. Pat. No. 6,521,175 to Mourer et al., for which the degree of process control to achieve uniform grain size within the desired 6-8 range has been found to be more difficult.

BRIEF SUMMARY OF THE INVENTION

The present invention provides a method of forming a component from a gamma-prime precipitation-strengthened nickel-base superalloy so that, following a supersolvus heat treatment, the component is characterized by a desirable, substantially uniform grain size distribution. As an example, if the desired grain size range for a nickel-base superalloy article is ASTM 6 to ASTM 8, the present invention is capable of avoiding random grain growth that would produce individual grains or small regions of grains coarser than about ASTM 3, or small regions of grains coarser than about ASTM 3, or large regions of the forging that are uniform in grain size but with a grain size coarser than the desired ASTM 6-8 range.

The method includes forming a billet having a sufficiently fine grain size to achieve superplasticity of the superalloy during a subsequent working step. The billet is then worked at a temperature below the gamma-prime solvus temperature of the superalloy to form a worked article, with the billet being worked to maintain strain rates above a lower strain rate limit to control average grain size and below an upper strain rate limit to avoid critical grain growth. The worked article is then heat treated at a temperature above the gamma-prime solvus temperature of the superalloy for a duration sufficient to uniformly coarsen the grains of the worked article, after which the worked article is cooled at a rate sufficient to reprecipitate gamma-prime within the worked article.

A significant advantage of this invention is that, in addition to avoiding critical grain growth, the process window for working the billet is defined by the lower strain rate limit that has been shown to achieve significant control of the average grain size in the component and achieve a uniform grain size distribution within a desired narrower range and finer than previously possible. In this manner, mechanical properties of the component, including low cycle fatigue and tensile strength, can be improved. The method can be further refined by factoring strain energy into the working parameters to enable strain to be maximized and enable the use of strain rates near the upper strain rate limit to promote a uniform grain size without inducing critical grain growth.

Other objects and advantages of this invention will be better appreciated from the following detailed description.

DETAILED DESCRIPTION OF THE INVENTION

Figure 1:
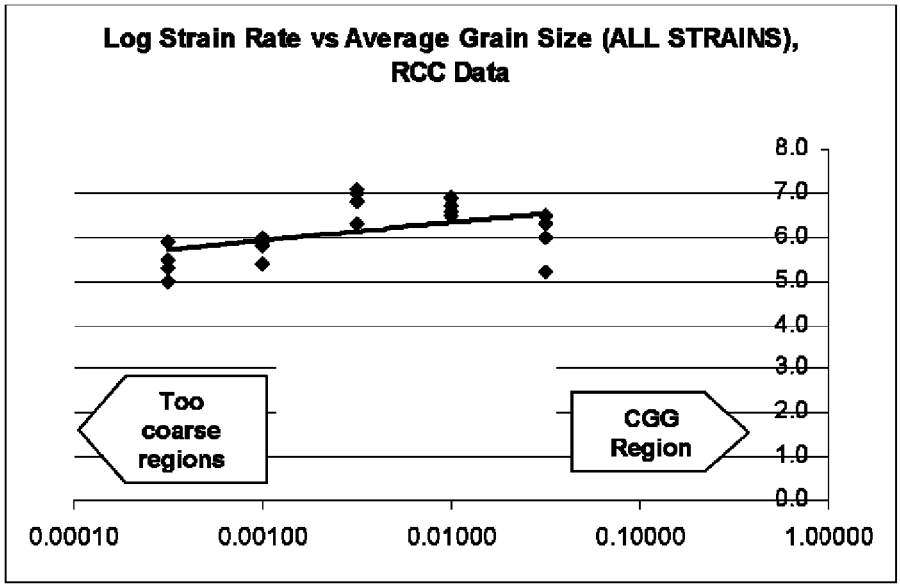
FIGS. 1 and 2 are graphs showing a relationship between average and ALA grain size, respectively, and strain rate in specimens formed by forging a powder metal gamma-prime, precipitation-strengthened nickel-base superalloy under different forging conditions.

For gamma-prime precipitation-strengthened nickel-base superalloys, nickel, chromium, tungsten, molybdenum, rhenium and cobalt are the principal elements which combine to form the gamma ($\gamma$) matrix, whereas aluminum, titanium, tantalum, niobium, and vanadium are the principal elements that combine with nickel to form a desirable strengthening phase of gamma-prime precipitate, principally $Ni_3(Al,Ti)$. When producing components such as high-pressure turbine disks of gas turbine engines by forging alloys of this type, a grain size not larger than about ASTM 10 is typically preferred during forging at temperatures at or near the recrystallization temperature but less than the gamma-prime solvus temperature of the alloy. After supersolvus heat treatment, during which grain growth occurs, such forgings typically have a preferred average grain size of about ASTM 3 to about ASTM 9. In accordancewith commonly-assigned U.S. Pat. Nos. 4,957,567 to Krueger et al., 5,529,643 to Yoon et al., and 5,584,947 to Raymond et al., placing an upper limit on the strain rate (critical strain rate, $\epsilon_c$) and an upper limit on the strain rate gradient (critical strain rate gradient) during forging avoids critical grain growth during supersolvus heat treatment.

The present invention identifies processing parameters by which a more desirable grain size distribution, resulting in improved control of the average grain size, can be achieved, in addition to avoidance of critical grain growth in a gamma-prime precipitation-strengthened nickel-base superalloys. According to one aspect of the invention, average grain size can be controlled by placing a lower limit on strain rate during forging, resulting in a strain rate window having a lower limit to control the average grain size in accordance with the present invention and an upper limit to avoid critical grain growth in accordance with Krueger et al., whose teachings regarding critical strain rates are incorporated herein by reference. However, it should be noted that the upper limit established by this invention was obtained with R104, which has a higher temperature capability and higher gamma prime content than the alloys evaluated by Krueger et al., Yoon et al., and Raymond et al., and that the upper limit of this invention was unexpectedly higher than that suggested by Krueger et. al., Yoon et al., and Raymond et al. It is also generally the intent of this invention to maintain the strain rate gradient below a critical level according to the teachings of Yoon et al., whose teachings regarding critical strain rate gradients are also incorporated herein by reference. According to this aspect of the invention, the effects of deviations outside the strain rate window of this invention can be minimized by following such deviations with as much forging deformation (strain) as possible within the strain rate window of this invention. Another aspect of this invention is to achieve a desirable average grain size within the strain rate window of this invention by placing a lower limit on the energy of deformation, or strain energy, imparted to the component during forging. Finally, another aspect of this invention is to achieve a desirable average grain size by forging slightly above the region of true superplasticity, where the flow stress is not completely uniform with strain.

The above-noted aspects of the invention will be discussed in reference to processing of a high-pressure turbine disk for a gas turbine engine. However, those skilled in the art will appreciate that the teachings and benefits of this invention are applicable to numerous other components.

In the production of high-pressure turbine disk from a gamma-prime, precipitation-strengthened nickel-base superalloy, a billet is typically formed to have a fine grain size, typically smaller than about ASTM 10, to achieve optimum superplasticity. The ability of a fine grain P/M forging to deform superplastically is also dependent on a factor called strain rate sensitivity (m), as well known in the art. In particular, superplastic materials exhibit a low flow stress as represented by the following equation:

$$\sigma=K\dot{\epsilon}^m$$

where $\sigma$ is the flow stress, K is a constant, $\dot{\epsilon}$ is the strain rate, and m is the strain rate sensitivity. Whether formed by powder metallurgy, spraycast forming, cast and wrought, or another suitable method, a billet of the superalloy must be formed under conditions, including a specified temperature range, to produce the desired fine grain size, as is known to those skilled in the art. Such conditions must also maintain a minimum strain rate sensitivity of about m=0.3 within the forging temperature range. Alternatively, to control the strain rate sensitivity, it has been conventional practice to control the forging process to be superplastic by forging in a regime of strain rate and temperature where flow stress is constant for any strain (no strain hardening or strain softening). However, as will be discussed below, the present invention has unexpectedly shown that optimum grain size can be achieved by forging just above this region, where some degree of flow hardening followed by flow stress decay was observed.

The billet can be formed by hot isostatic pressing (HIP) or extrusion consolidation, that latter of which preferably using a sufficiently low ram speed to prevent adiabatic heating and limited only by equipment tonnage limitations and excessive chilling. As known in the art, consolidation preferably yields a fully dense, fine grain billet preferably having at least about 98% theoretical density. Prior to working the billet, a forging preheat step is typically performed in a manner that prevents coarsening of the grains and a loss of the superplasticity advantageously achieved by the previous step. In particular, the heating cycle must be carefully controlled to prevent coarsening of the overall grain size, which would reduce superplasticity and undesirably increase flow stresses.

The billet is then hot worked (e.g., forged) to form a component having a desired geometry, followed by a supersolvus (solution) heat treatment. It is also known that, under certain conditions, an extended subsolvus annealing process or a low heating rate to the supersolvus heat treatment temperature may be desired to dissipate stored strain energy within the article and equilibrate the temperature of the component, as taught in Yoon et al. Dissipation of stored strain energy can serve to reduce nonuniform nucleation tendencies of the superalloy, such that the tendency for critical grain growth in the component is also reduced. Though the teachings of Yoon et. al. were found to apply to the present invention, the higher volume fraction of gamma-prime in the class of alloys of particular interest to the present invention, which includes R104 and other superalloys with gamma prime volume fractions of about 50% or more, appears to make these alloys less sensitive to details of the subsolvus anneal. The supersolvus heat treatment is performed at a temperature above the gamma prime solvus temperature (but below the incipient melting temperature) of the superalloy, and serves to recrystallize the worked grain structure and dissolve (solution) the gamma prime precipitates in the superalloy. A suitable supersolvus temperature is typically about 30 to 50° F. (about 15 to 30° C.) above the gamma-prime solvus temperature of an alloy. Following the supersolvus heat treatment, the component is cooled at an appropriate rate to re-precipitate gamma prime within the gamma matrix or at grain boundaries, so as to achieve the particular mechanical properties desired. An example of a suitable cooling step includes controlled air cooling or controlled air cooling for a brief period followed by quenching in oil or another suitable medium. The component may also be aged using known techniques with a short stress relief cycle at a temperature above the aging temperature of the alloy if desirable to reduce residual stresses.

As known in the art, in addition to grain recrystallization and solutioning gamma prime precipitates, heating the superalloy above its gamma prime solvus temperature also causes grain growth (coarsening), typically to obtain grain sizes larger than about ASTM 9, such as about ASTM 3 to 9 and more preferably ASTM 6 to 8, to achieve the mechanical properties desired for the component. For optimum mechanical properties, uniform grain sizes within a range of about 2 or 3 ASTM units are typically desirable. Regions of the component with grain sizes in excess of about 2 to 3 ASTM units coarser than the desired grain size range are undesirable in that the presence of such grains can significantly reduce the low cycle fatigue resistance of the component and have a negative impact on other mechanical properties of the component, such as tensile and fatigue strength. For example, a component having a desired grain size range of about ASTM 6-8 is preferably free of isolated grains and small regions of grains larger than ASTM 3 (though widely scattered grains slightly larger may be tolerable), and free of significant regions coarser than about ASTM 6. As noted above, excessively large grains caused by critical grain growth can be avoided during working of the billet by maintaining strain rates below a critical (maximum) strain rate ($\dot{\epsilon}_c$) for the superalloy in accordance with Krueger et al. However, mechanical properties can be further promoted by controlling the grain size distribution and average grain size within a desired grain size range. According to the present invention, this goal can be achieved by imposing a minimum strain rate above which strain rates during working of a superalloy billet are maintained, with the result that a strain rate window is employed within which working of the billet is performed.

According to Krueger et al., the maximum strain rate, $\dot{\epsilon}_c$, is composition, microstructure, and temperature dependent, and can be determined for a given superalloy by deforming test samples under various strain rate conditions, and then performing a suitable supersolvus heat treatment. $\dot{\epsilon}_c$ is then defined as the strain rate which, when exceeded during deformation and working of a superalloy and accompanied by a sufficient amount of total strain, will result in critical grain growth after supersolvus heat treatment. Accordance to the present invention, in which a minimum strain rate is identified as being critical to controlling average grain size after supersolvus heat treatment, strain rates below the minimum strain rate can result in an average grain size that is larger than desired for optimal properties. As with the maximum strain rate identified by Krueger et al., the precise value for the minimum strain rate parameter of this invention appears to vary depending on the composition and microstructure of the superalloy in question. Minimum strain rates for regions within large components can be predicted analytically by performing experiments on small laboratory specimens, and then using modeling techniques to predict local deformation behavior within the components.

Figure 2:
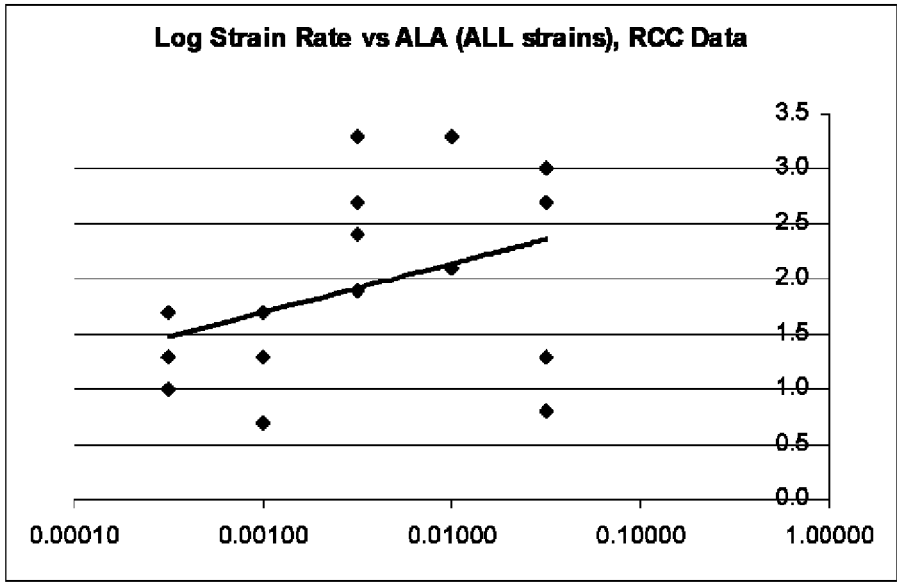

In an investigation leading to the present invention, the relationship between final grain size and strain rate, including minimum strain rate of this invention, was evidenced from testing performed on subscale right circular cylinder (RCC) and double cone (DC) specimens. All specimens were formed of the superalloy René 104 (R104), disclosed in commonly-assigned U.S. Pat. No. 6,521,175 to Mourer et al. as having a composition of, by weight about 16.0-22.4% cobalt, about 6.6-14.3% chromium, about 2.6-4.8% aluminum, about 2.4-4.6% titanium, about 1.4-3.5% tantalum, about 0.9-3.0% niobium, about 1.9-4.0% tungsten, about 1.9-3.9% molybdenum, 0.0-2.5% rhenium, about 0.02-0.10% carbon, about 0.02-0.10% boron, about 0.03-0.10% zirconium, one or more of up to 2% vanadium, up to 2% iron, up to 2% hafnium, and up to 0.1% magnesium, the balance nickel and incidental impurities. The actual chemistry of each specimen was, by weight, about 20.52% cobalt, about 12.93% chromium, about 3.31% aluminum, about 3.56% titanium, about 2.25% tantalum, about 0.88% niobium, about 2.06% tungsten, about 3.78% molybdenum, about 0.055% carbon, about 0.02% boron, about 0.05% zirconium, about 0.10% iron, about 36 ppm vanadium, about 110 ppm hafnium, the balance nickel and incidental impurities including about 0.01% silicon, about 14 ppm manganese, about 9.5 ppm phosphorus, about 5 ppm sulfur, about 15 ppm copper, about 20 ppm nitrogen, and about 119 ppm oxygen. Each specimen was forged at a temperature of about 1925° F. (about 1050° C.), at a strain rate of about 0.00032, 0.001, 0.0032, 0.01, or 0.032 $sec^{-1}$, and at a nominal strain level of about 0.3, 0.5, 0.7, 0.9, or 1.1%. FIG. 1, which plots strain rate versus average ASTM grain size for a first set of the RCC specimens, suggests that a critical strain rate upper limit ($\dot{\epsilon}_c$) for critical grain growth exists at or above about 0.032 $sec^{-1}$, such as 0.1 $sec^{-1}$. However, FIG. 1 also evidences that there is a significant difference in the average grain size and grain size range for specimens forged at much lower strain rates, with specimens forged at strain rates of 0.001 $sec^{-1}$ and less having coarser grains. FIG. 2, which plots ALA grain size values for the specimens, evidences that ALA grain size is also a function of strain rate. As known in the art ALA grain size is according to ASTM Standard E 930, and is useful to measure the size of unusually large grains in an otherwise uniformly fine grain size distribution. From FIGS. 1 and 2, strain rates above about 0.001 $sec^{-1}$ appear to be beneficial for controlling average grain size. From these results, it was concluded that a minimum strain rate should be used to bound the forging conditions, resulting in a strain rate window capable of achieving a more homogeneous grain size within a forged component.

Figure 3:
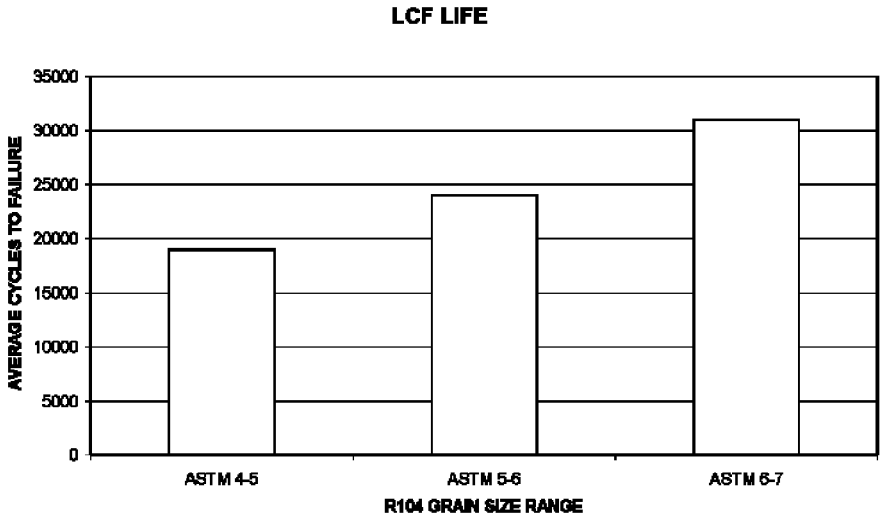
FIGS. 3 through 5 are bar graphs representing the type of affect that grain size can have on low cycle fatigue (LCF) life, ultimate tensile strength (UTS), and ultrasonic noise levels during sonic inspection of components forged from powder metal gamma-prime, precipitation-strengthened nickel-base superalloys.
Figure 4:
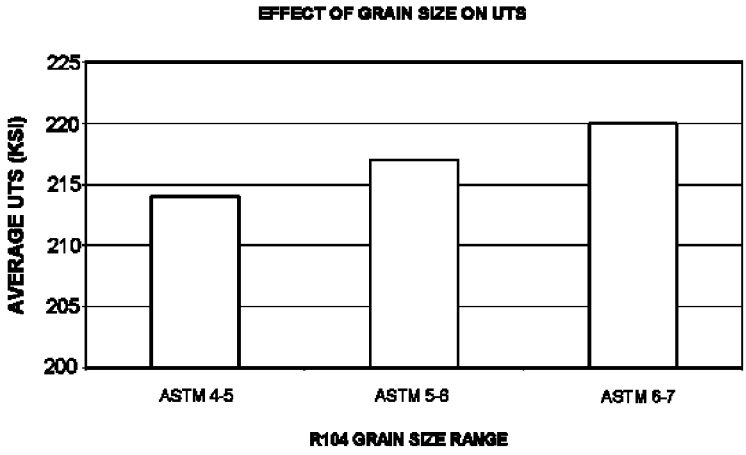
Figure 5:
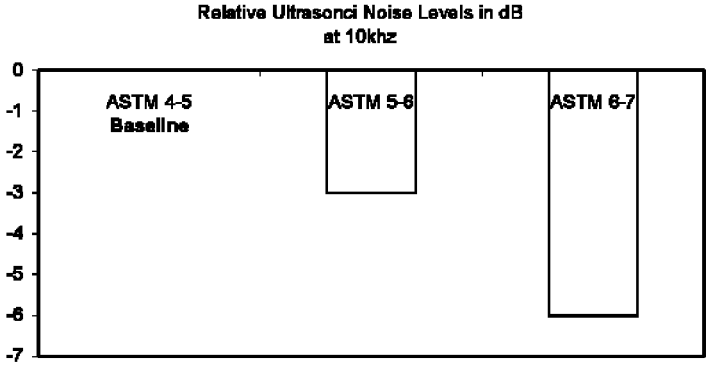

It should be noted here that the ability to achieve a more homogeneous grain size, such as that achieved within the minimum and maximum strain rate limits indicated by FIGS. 1 and 2 for the R104 superalloy, is advantageous from several perspectives. FIG. 3 is a graph estimating grain size versus low cycle fatigue trends for the superalloy KM4 (U.S. Pat. No. 5,143,563), and evidences that restricting the strain rate regime and achieving a finer grain size has a beneficial effect on low cycle fatigue life. As known in the art, low cycle fatigue life is a critical parameter in the service life of a turbine disk and a key driver for the overall economics of a forged article. FIG. 4 graphs values for grain size versus ultimate tensile strength (UTS) trends extrapolated from testing of R104 specimens with grain sizes in the range of about ASTM 4 to 5. As evident from FIG. 4, restricting the strain rate regime and achieving a finer grain size tends to improve ultimate tensile strength, a critical factor in yield behavior driven by disk stress. Finer grain size and grain size uniformity is also advantageous when performing sonic inspections by reducing noise, as evident from FIG. 5. The noise reduction of 6 dB achieved with specimens having grain sizes in the range of about ASTM 6 to 7 can result in a 2× improvement in minimum defect size detection capability over specimens with grain sizes of about ASTM 4 to 5.

Figure 6:
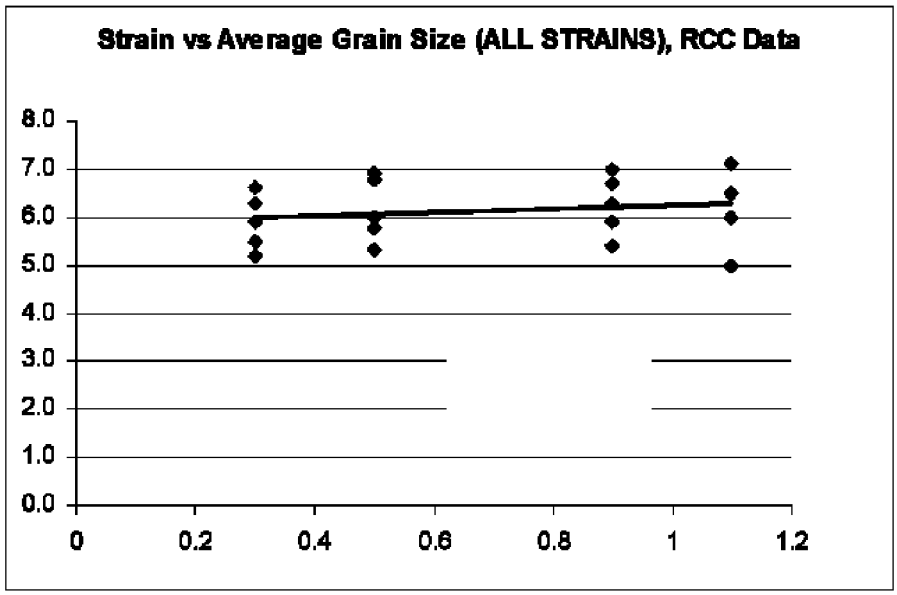
FIGS. 6 and 7 are graphs plotting average and ALA grain size, respectively, versus nominal strain for the specimens of FIGS. 1 and 2.
Figure 7:
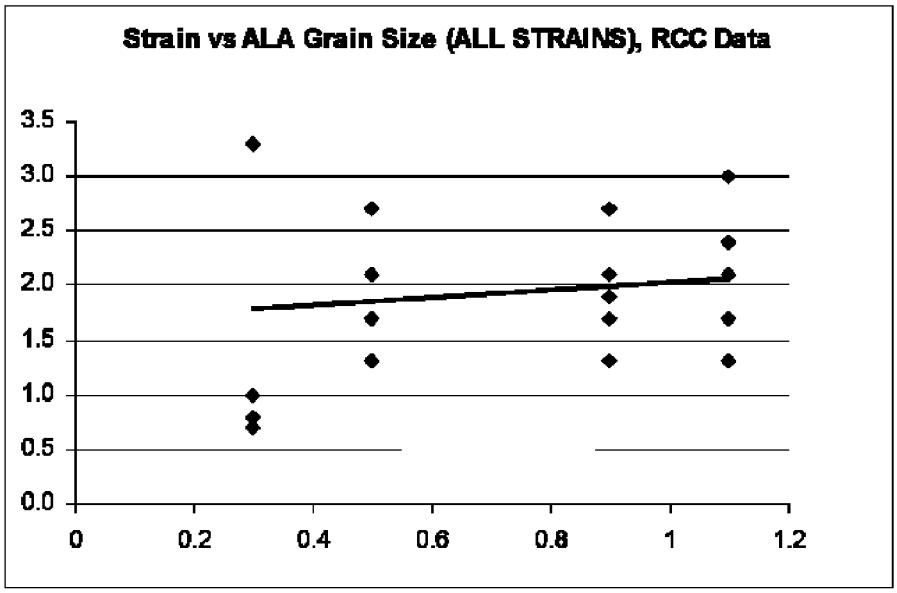
Figure 8:
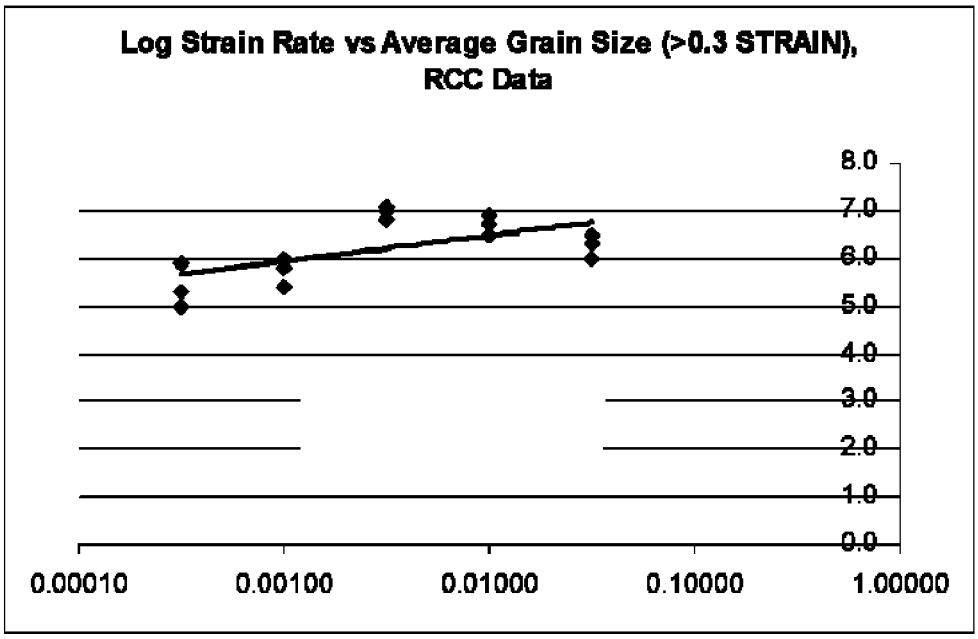
FIGS. 8 and 9 are graphs plotting the data of FIGS. 1 and 2, respectively, but for only those specimens forged at strains above 0.3.
Figure 9:
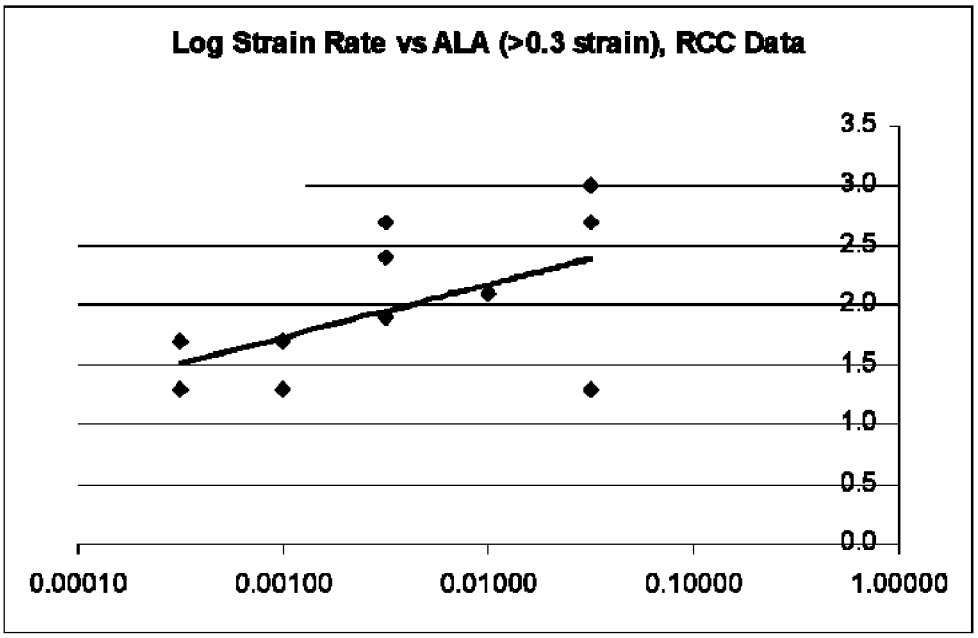

Further analysis of the data obtained from the RCC specimens used to generate the data of FIGS. 1 and 2 was then conducted to evaluate the influence of strain on average grain size. FIGS. 6 and 7 plot average and ALA grain size, respectively, versus nominal strain for the specimens, and evidence that a rather weak relationship appears between average grain size and strain, though a stronger trend appears evident with the ALA grain size data of FIG. 7. From this data, it was concluded that a minimum nominal strain for the R104 superalloy appeared to be about 0.3, with a preferred minimum strain being about 0.5. To further assess a possible interaction between strain and strain rate, the data of FIGS. 1 and 2 corresponding to strains of 0.5 to 1.1 were replotted in FIGS. 8 and 9, which suggest that the impact of strain rate on grain size is greatest at lower levels of strain. Stated another way, for strain rates within the strain rate window identified with FIGS. 1 and 2, higher strains promoted favorable grain size refinement in the R104 specimens.

Practically developing forging processes that remain within the strain rate window and the minimum strain desired with this invention requires the use of multiple iterations of forge modeling and die design to arrive at a process that will minimize deviations outside these limits yet is within other constraints of die load, press capacity, billet diameter, etc. Forging processes usually involve practical limitations that make absolute avoidance of any deviations very difficult. Therefore, it would be desirable if additional parameters were identified that could be used to help maintain the forge process within an acceptable range of deformation strain and strain rate so that grains of an acceptable size, size range, and size distribution were obtained after final supersolvus heat treatment. For this purpose, the present invention further identifies a factor for assessing the energy of deformation (strain energy) imparted to a workpiece during forging or other hot working.

Strain energy is understood to be the work or energy put into a material during a deformation process. The flow stress of the material during deformation is a measure of the resistance offered by the material to deformation, whereas strain is a measure of the amount of the deformation. Therefore, integration of the flow stress over the deformation strain path represents the work or energy put into the material, which can be calculated on the following basis.

$$\text{Total strain energy}=\int\sigma d\epsilon=\Sigma\sigma\Delta\epsilon\text{(units:ksi·inch/inch)}$$

Implicit in the definition of strain energy is that it depends not just on the total accumulated strain, but also on the deformation path along which that strain is obtained, because flow stress depends on local strain, strain rate, and temperature, i.e., the deformation path taken. As such, two locations within a forging could have the same total accumulated strain but vastly different strain energies depending on the deformation path. The location with a higher strain rate would be deformed at a higher flow stress (note flow stress increases with strain rate) would have a higher strain energy than a location deformed at a lower strain rate. A similar difference would exist between locations deformed at different temperatures. According to the strain energy approach of this invention, such different locations would have different grain sizes brought out by their different levels of strain energy, and not just their different levels of strain as taught in the prior art.

In the present invention, in which it is desired to define and use an acceptable forging process to obtain a desirable average grain size in, for example, a high-pressure turbine disk forging, the critical strain rate taught by Krueger et al. remains viable as a maximum upper limit for strain rate to avoid critical grain growth. In view of the foregoing discussion, the forging process would also be required to achieve strain rates within the strain rate window of this invention, and preferably maintain a minimum nominal strain of at least 0.3 and preferably 0.5. According to the strain energy approach of the present invention, it would be possible to cap the upper strain limit on the basis of a strain energy parameter to avoid excessive energy storage.

Figure 12:
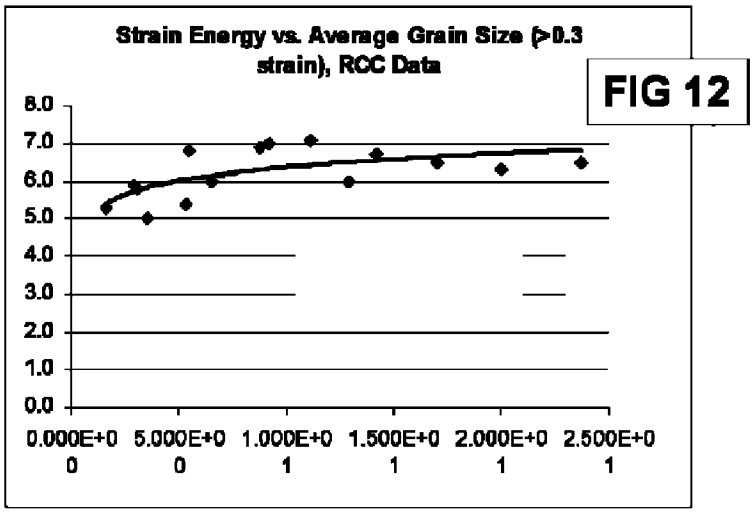
FIGS. 12 and 13 are graphs plotting the data of FIGS. 10 and 11, respectively, but for only those specimens forged at strains above 0.3.
Figure 13:
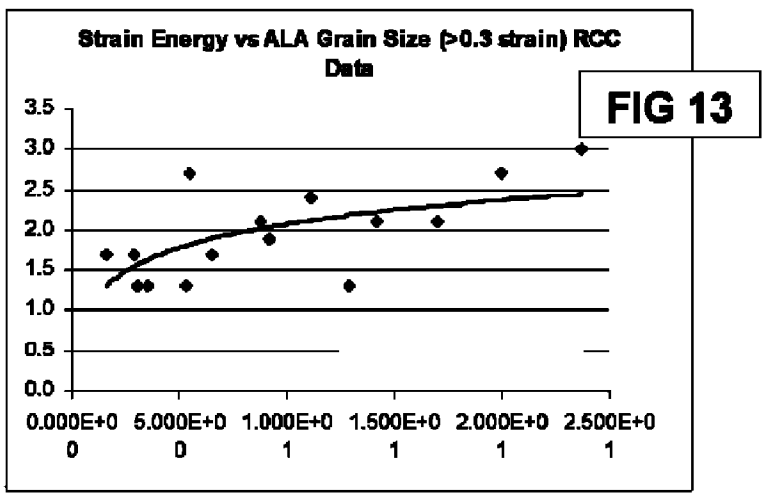
Figure 10:
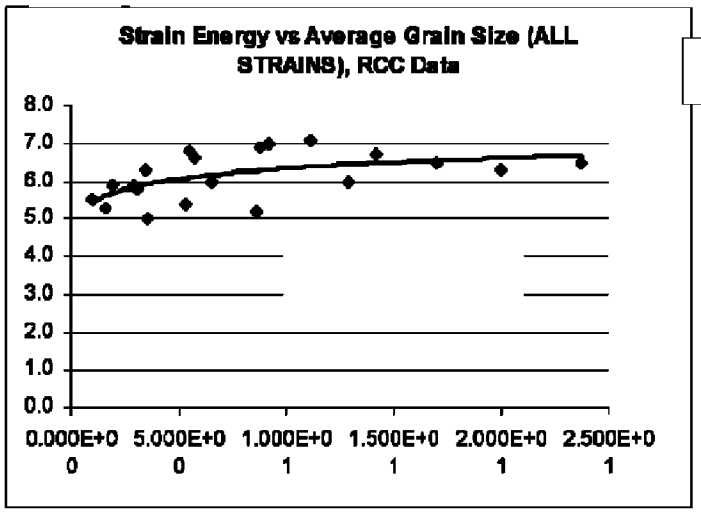
FIGS. 10 and 11 are graphs plotting average and ALA grain size, respectively, versus strain energy imparted in the specimens of FIGS. 1 and 2.
Figure 11:
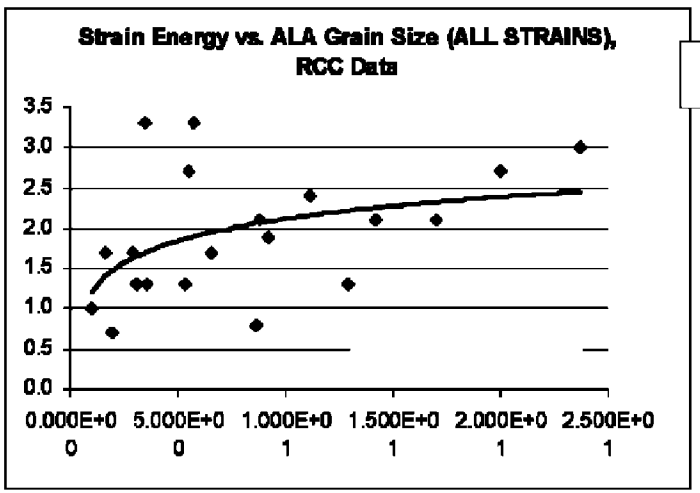

In investigating this aspect of the invention, data obtained from the RCC specimens discussed in reference to FIGS. 1 through 9 were also correlated to the strain energy parameter. FIGS. 10 and 11 are graphs plotting average and ALA grain size, respectively, versus strain energy imparted to each of the RCC specimens evaluated. FIGS. 12 and 13 also plot average and ALA grain size, respectively, versus strain energy (ksi·inch/inch), but only for those specimens subjected to strains above 0.3. FIGS. 10 through 13 evidence that a relationship exists between grain size and the strain energy parameter of this invention. From FIGS. 10 and 11, it can be seen that the relationship between strain energy and grain size is reasonably good, while a stronger correlation is evident from FIGS. 12 and 13 when strain is within the preferred range of this invention.

From FIGS. 10 through 13, it is evident that a factor beyond strain rate and strain is also important in controlling grain size, that is, the amount of energy put into the forging prior to supersolvus heat treatment drives, and could be correlated to, the final grain size. Therefore, FIGS. 10 through 13 suggest that a process window can be defined by a combination of minimum strain rate to provide sufficient grain refinement, a maximum strain rate to avoid critical grain growth, as well as a suitable "path" of deformation to combine strain and strain rate into a process that optimizes how and how much strain energy is imparted during the forging process.

Based on the investigations and results discussed above, a subsequent investigation as carried out with high-pressure turbine disk forgings to confirm the above-described findings regarding the ability to control average grain size by placing a lower limit on strain rate, a lower limit on nominal strain, and using strain energy as an additional forging process parameter in accordance with the present invention. The disks were formed from R104 by powder metallurgy, extrusion consolidation, forging, and supersolvus heat treatment at about 2140° F. (about 1170° C.). Three groups of disks were forged using nominally isothermal processes designed to achieve the following goals: forging a first group at controlled levels of superplasticity; forging a second group partially at these superplastic levels and partially just above the superplastic region; forging a third group just above the superplastic region. All forgings were free of critical grain growth, meaning that there were no very large grains formed in an unrestrained fashion.

As discussed above in reference to the data obtained from the RCC specimens, the forging parameters of this invention can be established empirically, though forging simulation models can also be useful to establish strain, strain rate, temperature, and related parameters for forging operations. As understood by those skilled in the forging art, a forging process can be designed using simulation models to produce die shapes and achieve a forging press operation that controls the local strain and strain rate history of regions of the forgings within desired parameters. Using this approach with the three groups of disks evaluated in this investigation, three forging trials were able to be used to confirm the laboratory RCC specimen data. The forgings in all three groups were made using multiple forging steps. The deformation parameters in the steps were varied.

In the first group of the forgings, the final forging step and the step immediately preceding it were controlled to a low level of strain rate, below about 0.008 $sec^{-1}$ on a local limit basis, and the overall forging process was designed to maintain all regions of the forging within this limit. Operation of the forging press was performed by the forging manufacturer using forging methods tailored to maintain the local strain rate within the 0.008 $sec^{-1}$ limit. The forgings in this group produced average grain sizes ranging from ASTM 4.0 to ASTM 5.1 in the shaft, ASTM 4.3 to ASTM 7.1 in the bore, and ASTM 6.7 to ASTM 7.1 in the rim. ALA grain sizes in this group ranged from ASTM 0.1 to ASTM 1.7 in the shaft, ASTM 1.1 to ASTM 3.3 in the bore, and ASTM 2.1 to ASTM 3.3 in the rim.

In the second group of the forgings, the step immediately preceding the final forging step was performed at an increased forging strain rate using an upper limit of 0.032 $sec^{-1}$ based on the results from the laboratory RCC specimens. The final step was again performed using the 0.008 $sec^{-1}$ maximum strain rate used with the first forging group. In addition, changes were made to the forging shapes to increase the local strains to increase the portions of the forgings that were above a target of 0.3 strain, based on results of the laboratory RCC specimens. As in the first forging group, the forging process was performed by the forging manufacturer as appropriate to maintain these local strain rate limits. The forgings in the second group produced average grain sizes ranging from ASTM 6.0 to ASTM 6.4 in the shaft, ASTM 5.0 to ASTM 6.6 in the bore, and ASTM 6.2 to ASTM 6.8 in the rim. ALA grain sizes of this group ranged from ASTM 2.7 to ASTM 4.1 in the shaft, ASTM 1.3 to ASTM 3.0 in the bore, and ASTM 3.3 to ASTM 4.1 in the rim.

In the third group of forgings, the step immediately preceding the final forging step was performed at an increased forging strain rate, and in addition the final step was also performed at the higher local limit of 0.032 $sec^{-1}$ maximum strain rate. As before, the forging process was performed by the forging manufacturer as appropriate to maintain these local strain rate limits. Forgings of this third group had average grain sizes ranging from ASTM 5.8 to ASTM 6.4 in the shaft, ASTM 6.7 to ASTM 7.6 in the bore, and ASTM 6.6 to ASTM 7.7 in the rim. ALA grain sizes for this group ranged from ASTM 2.1 to ASTM 3.3 in the shaft, ASTM 2.7 to ASTM 4.1 in the bore, and ASTM 3.3 to ASTM 4.1 in the rim.

In the third group of forgings, with which the method of this invention was employed, grain size averages overall were ASTM 5.8-7.7, with ALA grains ranging from ASTM 3.1-4.0. In contrast, the first group of forgings, which were not produced in accordance with the method of this invention, average overall grain size ranged from ASTM 4.0-7.1, with ALA grains ranging from ASTM 0.1 to 3.3. As such, the third group clearly demonstrated an improvement in grain refinement was achieved in full size forgings.

LCF testing was performed on disks from all three forging groups, with the best LCF life exhibited by the third forging group. In particular, increasing bore LCF life (which is particularly important in disk operation in gas turbine engines) was observed consistent with the improved grain size refinement achieved with the second forging group and particularly the third forging group.

Grain size data collected from this investigation indicated that appropriate maximum and minimum strain rate limits for the forged R104 disks were consistent with the RCC specimens of the earlier investigations, namely, about 0.1 $sec^{-1}$ and about 0.001 $sec^{-1}$, respectively. Accordingly, it was concluded that forging processes for R104 preferably avoid any deviations from this strain rate window. However, because the evaluations with the laboratory specimens and the subsequent examination of local deformation history in the full scale forgings showed that the final forging step has the greatest impact on forging grain size, it is believed that minimal deviations from this window can be at least partially ameliorated by following such deviations with as much forging deformation (strain) as possible within the strain rate window.

In an investigation leading to a final aspect of the invention, it was theorized that an optimum strain rate window could be related to the degree of superplasticity of the superalloy during forging. In particular, it was theorized that the strain energy approach could be analyzed from that standpoint of the strain rate and whether or not the superalloy is in the fully superplastic regime. For example, an excessively low strain rate would not impart enough stored energy into the forging to achieve a sufficiently fine grain during recrystallization at the supersolvus heat treatment. With this approach, a strain energy relationship can be characterized with an equation of the form:

$$\text{Grain size}=\Sigma f(\text{strain, strain rate, superplasticity, temperature})$$

where the summation sign ($\Sigma$) implies the sum of multiple "regimes" of forging and material variables during a forging operation. For example, in the forging of the multiple-step RCC specimens, it was found that an initial step of non-optimum strain level, or non-optimum strain rate, could still result in a desirable finish microstructure if the second step was performed at a more optimum strain or strain rate.

A strain energy analysis based on superplasticity appears to provide an explanation for the above-noted phenomenon. A strain energy parameter based on superplasticity can be used to design multiple step forging processes that produce grain size with a uniform desired final range. If the size and shape of the component are such that the part cannot be formed from a billet in one working operation, the strain energy approach can be used to balance the strain and strain rate used in each step of a multiple step operation to balance practical forging equipment constraints with desired strain and strain rate limits in the workpiece. In addition, strain and strain rate can be traded off against each other to impart the same energy by increasing one if practical limitations limit the amount of the other that can be imparted in any one forging step. According to this strain energy analysis model, the energy imparted to a superalloy during forging (or other hot working) must be in a relatively narrow range.

From an analytical approach, raising the strain rate to a power is a means to obtaining an energy component. Furthermore, the degree of superplasticity is believed to be key to the effect of the strain energy parameter of interest to this invention. For example, if a material were perfectly superplastic, no energy would be stored during hot working and the resulting driving force for grain nucleation would be low, resulting in coarse grains. On the other hand, if a material is significantly not superplastic, energy storage can be severe to the extent that the resulting grain nucleation and growth would tend to occur so rapidly that critical grain growth occurs. Finally, if a material is moderately superplastic in the regime where forging is practiced, it is possible for sufficient energy to be stored in the material to produce a finer grain size following heat treatment, and possibly in a controlled manner. This view of an energy-superplasticity relationship provides insight to the value of the strain energy parameter and a means to factor in appropriate ranges for both strain and strain rate that establish a forging process route capable of optimizing average grain size while also avoiding critical grain growth.

As noted above, the ability of a fine grain P/M forging workpiece to deform superplastically is related to its strain rate sensitivity (m), whose value is known to depend on grain size and is strongly influenced by thermal exposure ("soak time"). The value of "m" can be mapped throughout the strain rate vs. temperature matrix. Values of "m" below about 0.3 are known to lead to critical grain growth. In the present invention, it is theorized that a strain energy parameter based on superplasticity can be related to the value of "m." Data obtained from the RCC specimens discussed above were used to further show that the application of this approach is capable of defining optimum strain rates, strains, and temperatures to achieve desired grain sizes in P/M superalloy forgings.

Figure 14:
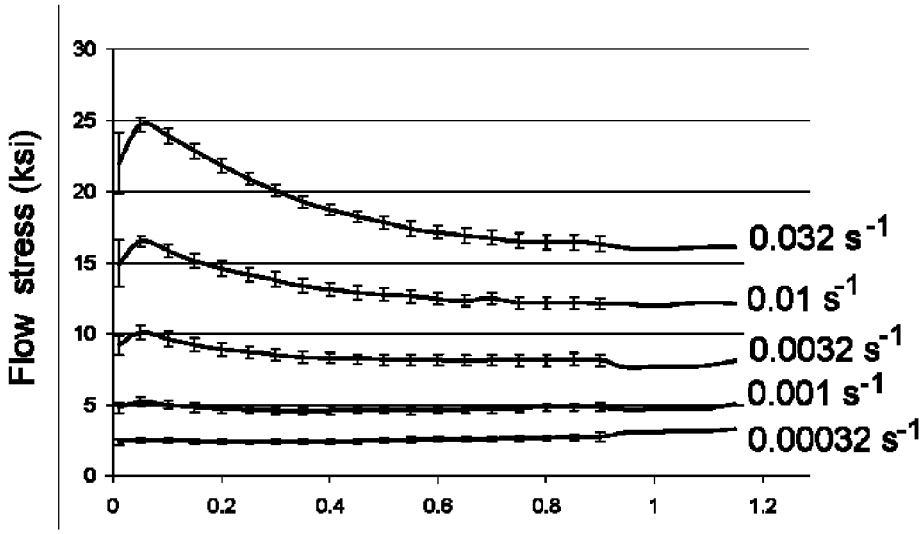
FIG. 14 is a graph showing the flow behavior of the specimens of FIGS. 1 and 2.

FIG. 14 plots flow stress versus strain, with individual curves corresponding to the different strain rates used to process the RCC specimens. The flatter portion of each curve corresponds to superplasticity. Surprisingly, the curves exhibiting greater superplasticity, namely, curves generated with strain rates of 0.00032 $sec^{-1}$ and 0.001 $sec^{-1}$, correspond to those specimens having coarser and more nonuniform grains in FIGS. 1 and 2, whereas the curves exhibiting lower superplasticity, namely, curves generated with strain rates of 0.0032 $sec^{-1}$, 0.01 $sec^{-1}$ and 0.032 $sec^{-1}$, correspond to those specimens having more uniform grains in FIGS. 1 and 2. From these results, it was theorized that coarser grain structures are generated with low strain rates where superplasticity and dislocation free grain boundary sliding dominate, and finer grain structures are generated with higher strain rates in the non-superplastic or marginally superplastic regime where dislocation build-up occurs to accommodate the imposed strain. The non-superplastic deformation is theorized to create energy storage, commonly referred to in the metalworking industry as "warm work", within the material that results in a finer grain size after supersolvus heat treatment.

Figure 15:
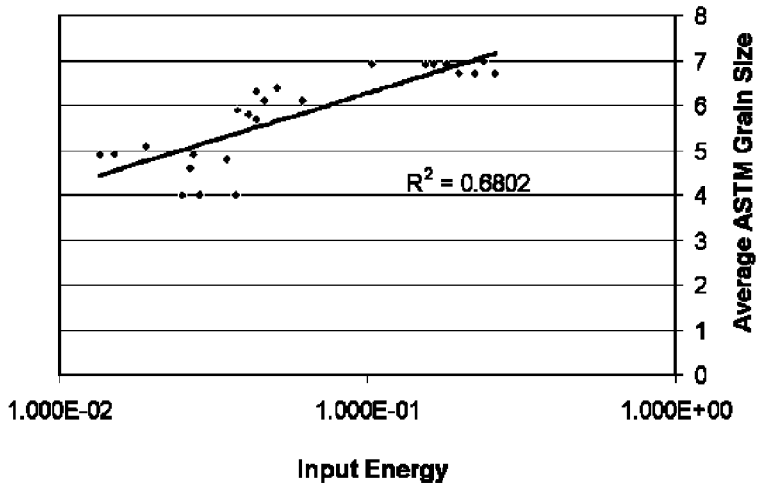
FIGS. 15 and 16 are graphs showing a relationship between average grain size and strain energy in large high-pressure turbine disks formed by forging powder metal gamma-prime, precipitation-strengthened nickel-base superalloys under different forging conditions.

On the basis of the above, data obtained from the disk forgings discussed above were correlated to a superplasticity-based strain energy parameter. In this analysis, a modified strain energy formulation was used. Strain energy was computed using flow stress calculated via proportionality to the strain rate raised to the power of "m" (strain rate sensitivity parameter), using the previously-noted flow stress equation $\sigma=K\dot{\epsilon}^m$. The scaling constant K was taken as 1. Other than this difference, the trends in the strain energy and the functional relationships with respect to other deformation variables remain the same. A value of 0.3 was used for "m" based on the above assumption that strain energy is related to the strain rate sensitivity factor "m," for which a value of 0.3 is required for superplasticity. From FIG. 15, which plots grain size versus the strain energy calculated from data obtained from the disk forgings, it can be seen that the relationship between "input" strain energy and grain size is reasonably good. Similar plots could be made for strain rate and strain and show how the components of the strain energy parameter also correlate. However, it is believed that this strain energy parameter has greater physical and statistical significance. FIG. 15 again evidenced that a factor beyond strain rate and strain was important in controlling grain size, that is, the amount of energy put into the forging prior to supersolvus heat treatment drives, and could be correlated to, the final grain size. Therefore, the data in FIG. 15 suggest that a process window can be defined by a combination of minimum strain rate to provide sufficient grain refinement, a maximum strain rate to avoid critical grain growth, as well as a suitable "path" of deformation to combine strain and strain rate into a process that optimizes how and how much strain energy is imparted during the forging process.

Figure 16:
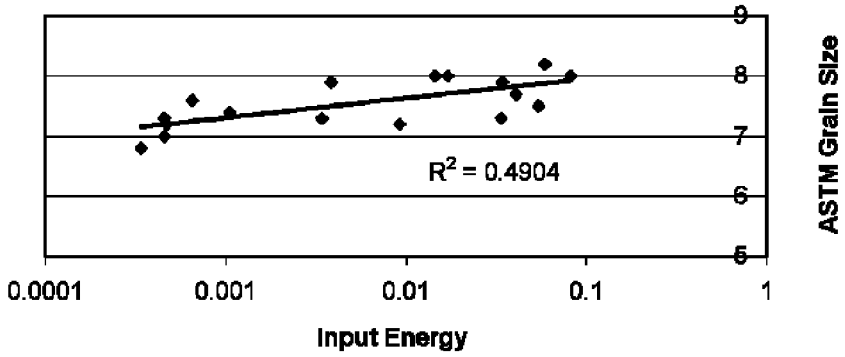

In a final investigation, high-pressure turbine disks formed of the superalloy René 88DT (U.S. Pat. No. 4,957,567) were also studied. R88DT is another gamma prime-strengthened nickel-base superalloy having a composition of, by weight, about 15.0 to 17.0% chromium, 12.0 to 14.0% cobalt, 3.5 to 4.5% molybdenum, 3.5 to 4.5% tungsten, 1.5 to 2.5% aluminum, 3.2 to 4.2% titanium, 0.5.0 to 1.0% niobium, 0.010 to 0.060% carbon, 0.010 to 0.060% zirconium, 0.010 to 0.040% boron, 0.0 to 0.3% hafnium, 0.0 to 0.01 vanadium, and 0.0 to 0.01 yttrium, the balance nickel and incidental impurities. Following the same process as described above for the R104 disks, a correlation was developed using grain size versus calculated strain energy, as shown in FIG. 16. The degree of statistical correlation, R2, was not as great for this investigation as in the R104 investigation. However, such a result was not entirely unexpected, as other investigations leading to this invention generally indicated that average grain size in R88DT is less sensitive to coarsening than R104 when forged at low strain rates.

On the basis of the foregoing, both R104 and R88DT exhibited strain rate sensitivity, wherein restricting lower strain rates can beneficially improve the average supersolvus grain size response. Furthermore, this effect has been determined to be broad and pervasive, encompassing other alloys such as ME209, CH98 (U.S. Pat. No. 5,662,749), and KM4 (U.S. Pat. No. 5,143,563), which behaved similarly to R104, as well as ME1-12, ME1-13, W5 (U.S. Pat. No. 5,080,734), and SR3 (U.S. Pat. No. 5,143,563), whose behavior was more similar to R88DT. As such all of these alloys, particularly the R104 group of alloys, were shown to benefit from the process parameters identified by this invention.

It is anticipated that the analytical model described above for the strain energy parameter could be refined with additional analysis and refinement of the energy equation functional form. In particular, the value of the exponent for strain rate, currently assumed to be about 0.3 (the limit of superplasticity for the strain rate sensitivity factor "m"), may actually vary and be a function of the actual, instantaneous "m" for a particular point of deformation. Nonetheless, the strain energy model discussed above evidenced a reasonable basis for optimizing a forging operation that takes into account both strain rate, strain, and temperature for the purpose of avoiding excessively coarse forging grain sizes.

The method of this invention makes possible the production of components from gamma-prime precipitation-strengthened nickel-base superalloys that are substantially free of critical grain growth, and also exhibit a more uniform grain size. While the benefits of the invention were described in reference to gamma-prime precipitation-strengthened nickel-base superalloy components from powder metal starting materials, other materials could be used including spraycast materials, cast and wrought materials, etc.

In view of the above, while the invention has been described in terms of particular embodiments, it is apparent that other forms could be adopted by one skilled in the art, such as by substituting other gamma-prime precipitation strengthened nickel-base superalloys, or by modifying the preferred method by substituting other processing steps or including additional processing steps. Accordingly, the scope of our invention is to be limited only by the following claims.

The invention claimed is:

1. A method of controlling the average grain size of a worked articled formed of a gamma-prime precipitation strengthened nickel-base superalloy having a gamma-prime solvus temperature, the method comprising the steps of:

consolidating a powder of the gamma-prime precipitation-strengthened nickel-base superalloy to form a billet having a sufficiently fine grain size to achieve superplasticity of the superalloy during a subsequent working step;

working the billet at a temperature below the gamma-prime solvus temperature of the superalloy so as to form the worked article, wherein the billet is worked above the superplastic regime in the non-superplastic or marginally superplastic regime while maintaining strain rates above a lower strain rate limit of 0.001 $sec^{-1}$ to control the average grain size of the worked article and below an upper strain rate limit to avoid critical grain growth, and so that strains within the billet are maximized on the basis of strain energy imparted to the billet during the working step, wherein the strain energy is estimated by strain rate within the billet raised to an exponential value.

2. The method according to claim 1, wherein the forming step comprises a hot isostatic pressing or extrusion consolidation process.

3. The method according to claim 1, further comprising the step of empirically establishing the lower strain rate limit.

4. The method according to claim 1, wherein the lower strain rate limit is 0.0032 $sec^{-1}$.

5. The method according to claim 1, further comprising the step of empirically establishing the upper strain rate limit.

6. The method according to claim 1, wherein the upper strain rate limit is 0.1 $sec^{-1}$.

7. The method according to claim 1, wherein the upper strain rate limit is about 0.032 $sec^{-1}$.

8. The method according to claim 1, wherein the billet is worked so that nominal strain within the billet is at least 0.3.

9. The method according to claim 1, wherein the billet is worked so that nominal strain within the billet is at least 0.5.

10. The method according to claim 1, wherein the billet is worked with sufficiently high strain rates so that working of the billet is substantially in the non-superplastic regime.

11. The method according to claim 1, wherein the strain energy is calculated by integration of the flow stress over the deformation strain path using the equation: total strain energy=$\Sigma\sigma\Delta\epsilon$.

12. The method according to claim 1, wherein the strain energy is estimated using the equation $K\dot{\epsilon}^m$, where K is 1, $\dot{\epsilon}$ is strain rate, and m is 0.3.

13. The method according to claim 1, wherein the exponential value is about 0.3.

14. The method according to claim 1, wherein the superalloy has a gamma prime volume fraction above 50%.

15. The method according to claim 1, wherein the superalloy consists of, in weight percent, about 16.0-22.4% cobalt, about 6.6-14.3% chromium, about 2.6-4.8% aluminum, about 2.4-4.6% titanium, about 1.4-3.5% tantalum, about 0.9-3.0% niobium, about 1.9-4.0% tungsten, about 1.9-3.9% molybdenum, 0.0-2.5% rhenium, about 0.02-0.10% carbon, about 0.02-0.10% boron, about 0.03-0.10% zirconium, one or more of up to 2% vanadium, up to 2% iron, up to 2% hafnium, and up to 0.1% magnesium, the balance nickel and incidental impurities.

16. The method according to claim 1, wherein the superalloy consists of, in weight percent, about 15.0-17.0% chromium, 12.0-14.0% cobalt, 3.5-4.5% molybdenum, 3.5-4.5% tungsten, 1.5-2.5% aluminum, 3.2-4.2% titanium, 0.5.0-1.0% niobium, 0.010-0.060% carbon, 0.010-0.060% zirconium, 0.010-0.040% boron, 0.0-0.3% hafnium, 0.0-0.01 vanadium, and 0.0-0.01 yttrium, the balance nickel and incidental impurities.

17. The method according to claim 1, further comprising the steps of:

annealing the worked article at a subsolvus temperature to dissipate stored strain energy within the worked article;

heat treating the worked article at a temperature above the gamma-prime solvus temperature of the superalloy for a duration sufficient to uniformly coarsen the grains of the worked article; and then cooling the worked article at a rate sufficient to reprecipitate gamma-prime within the worked article.

18. The method according to claim 17, wherein the heat treating step comprises heating the worked article to a temperature above the gamma-prime solvus temperature at a heating rate sufficient to dissipate stored strain energy within the worked article.

19. The method according to claim 17, further comprising the step of aging the worked article following the cooling step.

20. The method according to claim 17, further comprising the step of performing a stress relief cycle at a temperature above an aging temperature of the superalloy to reduce residual stresses in the worked article after the cooling step.

21. The method according to claim 17, wherein after the cooling step the grains of the worked article are substantially limited to a size range of about ASTM 6 to 8.

22. The method according to claim 21, wherein after the cooling step the grains of the worked article have an average grain size of between ASTM 6 and 8.

23. The method according to claim 1, wherein the grains of the worked article have an average grain size of between ASTM 6 and 8.

24. A method of controlling the average grain size of a worked articled formed of a gamma-prime precipitation strengthened nickel-base superalloy having a gamma prime volume fraction above 50% and a gamma-prime solvus temperature, the method comprising the steps of:

consolidating a powder of the gamma-prime precipitation-strengthened nickel-base superalloy to form a billet having a sufficiently fine grain size to achieve superplasticity of the superalloy during a subsequent working step;

working the billet at a temperature below the gamma-prime solvus temperature of the superalloy so as to form the worked article, wherein the billet is worked above the superplastic regime in the non-superplastic or marginally superplastic regime while maintaining a nominal strain within the billet of at least 0.3, strain rates above a lower strain rate limit of 0.001 $sec^{-1}$ to control the average grain size of the worked article and below an upper strain rate limit of 0.1 $sec^{-1}$ to avoid critical grain growth in the worked article, and so that strains within the billet are maximized on the basis of strain energy imparted to the billet during the working step, wherein the strain energy is estimated by strain rate within the billet raised to an exponential value;

heat treating the worked article at a temperature above the gamma-prime solvus temperature of the superalloy for a duration sufficient to uniformly coarsen the grains of the worked article; and cooling the worked article at a rate sufficient to reprecipitate gamma-prime within the worked article.

25. The method according to claim 24, wherein the upper strain rate limit is about 0.032 $sec^{-1}$.

26. The method according to claim 24, wherein the billet is worked so that nominal strain within the billet is at least 0.5.

27. The method according to claim 24, wherein the billet is worked with sufficiently high strain rates so that working of the billet is substantially in the non-superplastic regime.

28. The method according to claim 24, wherein the strain energy is calculated by integration of the flow stress over the deformation strain path using the equation: total strain energy=$\Sigma\sigma\Delta\epsilon$.

29. The method according to claim 24, wherein the strain energy is estimated using the equation $K\dot{\epsilon}^m$, where K is 1, $\dot{\epsilon}$ is strain rate, and m is 0.3.

30. The method according to claim 24, wherein the exponential value is about 0.3.

31. The method according to claim 24, wherein the superalloy consists of, in weight percent, about 16.0-22.4% cobalt, about 6.6-14.3% chromium, about 2.6-4.8% aluminum, about 2.4-4.6% titanium, about 1.4-3.5% tantalum, about 0.9-3.0% niobium, about 1.9-4.0% tungsten, about 1.9-3.9% molybdenum, 0.0-2.5% rhenium, about 0.02-0.10% carbon, about 0.02-0.10% boron, about 0.03-0.10% zirconium, one or more of up to 2% vanadium, up to 2% iron, up to 2% hafnium, and up to 0.1% magnesium, the balance nickel and incidental impurities.

32. The method according to claim 24, further comprising the step of annealing the worked article prior to the heat treating step to dissipate stored strain energy within worked article.

33. The method according to claim 24, wherein the heat treating step comprises heating the worked article to a temperature above the gamma-prime solvus temperature at a heating rate sufficient to dissipate stored strain energy within the worked article.

34. The method according to claim 24, further comprising the step of aging the worked article following the cooling step.

35. The method according to claim 24, further comprising the step of performing a stress relief cycle at a temperature above an aging temperature of the superalloy to reduce residual stresses in the worked article after the cooling step.

36. The method according to claim 24, wherein after the cooling step the grains of the worked article are substantially limited to a size range of about ASTM 6 to 8.

37. The method according to claim 24, wherein after the cooling step the grains of the worked article have an average grain size of between ASTM 6 and 8.

* * * * *